US006240982B1

(12) United States Patent
Bonne

(10) Patent No.: US 6,240,982 B1
(45) Date of Patent: Jun. 5, 2001

(54) GASOLINE VAPOR RECOVERY SYSTEM

(75) Inventor: Ulrich Bonne, Hopkins, MN (US)

(73) Assignee: Parker Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/469,910

(22) Filed: Dec. 22, 1999

Related U.S. Application Data

(60) Provisional application No. 60/144,691, filed on Jul. 20, 1999.

(51) Int. Cl.[7] ..... B65B 31/00

(52) U.S. Cl. ..... 141/59; 141/7; 141/95

(58) Field of Search ..... 141/5, 7, 59, 83, 141/94, 95, 290

(56) References Cited

U.S. PATENT DOCUMENTS

| | | | | |
|---|---|---|---|---|
| Re. 35,238 | | 5/1996 | Pope | 141/59 |
| 5,038,838 | * | 8/1991 | Bergamini et al. | 141/59 |
| 5,040,577 | | 8/1991 | Pope | 141/59 |
| 5,156,199 | * | 10/1992 | Hartsell, Jr. et al. | 141/83 |
| 5,280,814 | | 1/1994 | Stroh | 141/83 |
| 5,332,008 | * | 7/1994 | Todd et al. | 141/5 |
| 5,417,256 | * | 5/1995 | Hartsell, Jr. et al. | 141/7 |
| 5,507,325 | | 4/1996 | Finlayson | 141/83 |
| 5,542,458 | | 8/1996 | Payne | 141/7 |
| 5,592,979 | * | 1/1997 | Payne et al. | 141/59 |
| 5,782,275 | * | 7/1998 | Hartsell, Jr. et al. | 141/94 |
| 5,992,395 | * | 11/1999 | Hartsell, Jr. et al. | 123/516 |

* cited by examiner

*Primary Examiner*—Lee Young
*Assistant Examiner*—Peter deVore
(74) *Attorney, Agent, or Firm*—Renner, Otto, Boisselle & Sklar, LLP

(57) ABSTRACT

A gasoline vapor recovery system wherein, during winter conditions, the volume of air/fuel vapor delivered to the storage tank is less than the volume of liquid gasoline removed from the tank but expands upon saturation within the storage tank to be approximately the same volume as the liquid gasoline removed. The volume of vapor to be delivered to the storage tank is based on pressure differential between the fuel vapor saturation pressure at a measured temperature at the storage tank and on the fuel vapor pressure of the air/fuel fluid delivered to the storage tank. During summer conditions, the volume of the air/fuel vapor delivered to the storage tank is controlled to be equal to the volume of liquid gasoline removed from the storage tank by drawing excess air into the nozzle.

18 Claims, 1 Drawing Sheet

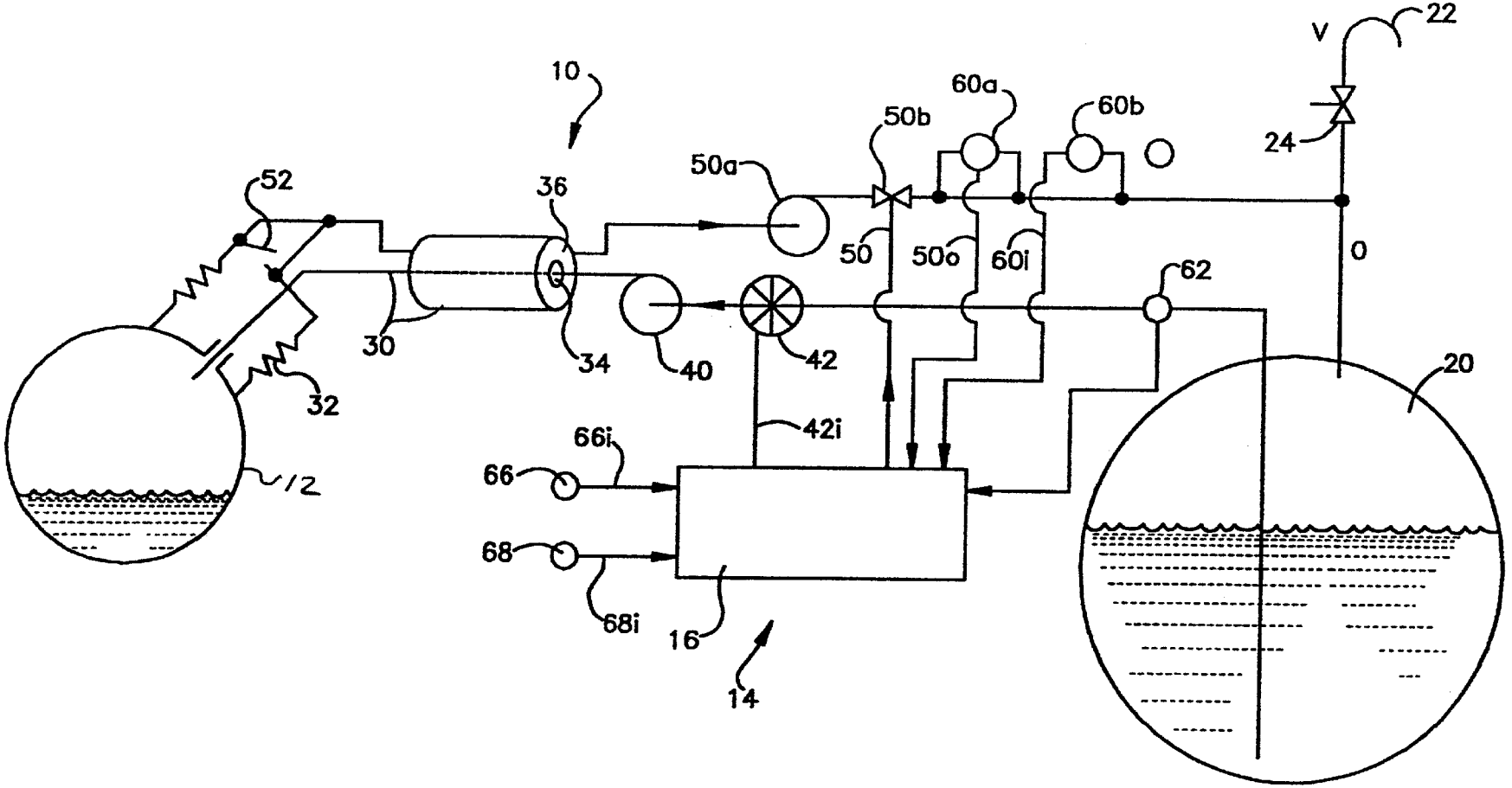
22
V
24
O
20
62
60b
60a
60i
50o
50b
50
50a
42
42i
40
14
16
10
36
34
66i
68i
66
68
30
32
52
12

GASOLINE VAPOR RECOVERY SYSTEM

RELATED APPLICATIONS

This application is a conversion of U.S. Provisional Application No. 60/144,691 filed on Jul. 20, 1999 under 35 U.S.C. §119(e).

FIELD OF THE INVENTION

The present invention relates generally as indicated to a gasoline vapor recovery system and more particularly to a gasoline vapor recovery system wherein the volume of air/fuel vapor delivered to the storage tank takes into account potential saturation within the storage tank after delivery.

BACKGROUND AND SUMMARY OF THE INVENTION

An automobile or car is typically fueled at a service station by a gasoline dispensing apparatus which transfers a volume of liquid gasoline ($V_{liquid}$) from a storage tank into the car's fuel tank. When the volume of liquid gasoline ($V_{liquid}$) is dispensed into the car's fuel tank, it displaces the same volume of fuel/air vapor within the car's fuel tank ($V_{car}$). A gasoline recovery system is usually provided to prevent the excessive release of this fuel/air vapor into the atmosphere at the vapor. This recovery system transfers fuel/air vapor released from the car's fuel tank back to the storage tank. The storage tank is usually situated underground and includes a vent for releasing vapor and introduced air to equalize the pressure of the storage tank.

In a typical gasoline dispensing apparatus, a fuel hose extends from the storage tank to a nozzle that may be selectively triggered to dispense the liquid gasoline into the car's fuel tank. The same fuel hose is also commonly used to transport the displaced air/fuel vapor back to the storage tank. A pump is provided to transport the liquid gasoline through the fuel hose and a liquid flow meter is provided to measure the volume of the liquid gasoline ($V_{liquid}$) delivered to the car's fuel tank. A suction pump is provided to transport the displaced air/fuel vapor through the fuel hose and the flow rate of this suction pump is controlled by the gasoline recovery system to achieve the desired flow rate. For example, if a variable speed suction pump is being used, the speed of the pump may be modulated. Alternatively, if a constant speed suction pump is being used, the position of appropriately placed dampers or valves may be changed.

The escape or release of fuel vapor into the atmosphere is referred to as "emission" and is usually expressed in terms of the percentage volume of pure gasoline vapor relative to the volume of dispensed liquid gasoline ($V_{liquid}$). "Nozzle emission" occurs if the volume of air/fuel vapor ($V_{car}$) transported back to the storage tank is less than the volume of displaced air/fuel vapor ($V_{liquid}$). "Vent emission" occurs if the storage tank becomes over pressurized and its vent is opened to release excess vapor. "Total emission" refers to the sum of nozzle emission and the vent emission.

As was indicated above, the liquid gasoline and the displaced air/fuel vapor are usually transported by the same fuel hose and these fluids are usually in a heat-exchanging relationship relative to each other as they counter flow through the fuel hose. For example, a fuel hose may include a central passageway through which the liquid gasoline is transported to the car's fuel tank and an outer annular passageway through which the displaced air/fuel vapor is transported to the storage tank. Assuming that the car's fuel tank is at the ambient temperature and the storage tank is situated underground, there will usually be a temperature differential between the car's fuel tank and the storage tank ($T_{car} \neq T_{storage}$) whereby a heat transfer will occur between the counter flowing fluids. Consequently, the volume of the air/fuel vapor withdrawn from the car's fuel tank will be different than the volume of the air/fuel vapor introduced into the storage tank ($V_{car} \neq V_{storage}$).

In winter conditions, the temperature of the car is less than the temperature of the storage tank ($T_{car} < T_{storage}$) and the volume of the vapor expands as it transferred from the car's fuel tank to the storage tank ($V_{car} < V_{storage}$). To eliminate nozzle emission, the recovery rate may be set so that the volume of vapor removed from the car's fuel tank ($V_{car}$) is the same as the volume of liquid gasoline dispensed thereinto. ($V_{car} = V_{liquid.}$) However, this would result in volume of vapor delivered to the storage tank ($V_{delivered}$) being greater than the volume of liquid gasoline removed from the storage tank ($V_{liquid}$). (The volume of the liquid gasoline ($V_{liquid}$) remains essentially unchanged since its thermal expansion coefficient is only about 0.0001/° C.)

The percentage increase in the volume of the vapor as it is transported from the car to the storage tank ($V_{delivered} - V_{car}$) due to thermal expansion is equal to the absolute temperature ratio ($t = T_{storage}/T_{car} > 1$). To eliminate excess volume due to thermal expansion, the volume of vapor removed from the car's fuel tank ($V_{car}$) may set to compensate for thermal expansion ($V_{car} = t\ V_{liquid}$). Since the volume of air/fuel vapor recovered ($V_{car}$) is not less than the volume of air/fuel vapor displaced in the car's fuel tank ($V_{liquid}$), nozzle emission is eliminated. However, since the volume of air/fuel vapor recovered ($V_{car}$) is greater than the volume of air/fuel vapor displaced in the car's fuel tank ($V_{liquid}$) excess air must be added to the recovery vapor.

When the excess air in the recovery vapor reaches the storage tank, it saturates with "fresh" gasoline vapor. This causes the just-delivered volume of air/fuel vapor to expand by a saturation factor of ($1 + \Delta p/p_{ambient}$) wherein $\Delta p$ is the difference between the saturation pressure of the fuel vapor of the storage tank conditions ($p_{sat}$(storage)) and the fuel vapor pressure at the car's fuel tank ($p_{vapor}$(car)). Thus, the saturation of vapor in the storage tank results in excess vapor volume in the storage tank ($V_{liquid} t \Delta p/p_{ambient}$). This excess volume is released via the storage tank vent causing a vent emission equal to the released excess vapor volume times the relevant saturation factor ($p_{sat}(T_{storage})/p_{ambient}$)).

By way of specific example, suppose that the fuel vapor is pentane ($C_5H_{12}$), the temperature of the car is 290° K ($T_{car}$) and the temperature of the storage tank is 300° K ($T_{storage}$). If volume of vapor removed from the car's fuel tank ($V_{car}$) is set to account for thermal expansion (1.033 $V_{liquid}$), there would be an approximately 34% percent (1.34 $V_{liquid}$) volume excess in the tank due to saturation expansion. The excess vapor volume released through the storage tank's vent would cause a storage emission, in percentage of the volume of dispensed liquid gasoline ($V_{liquid}$), of about 25% pentane. Thus, while nozzle emission is eliminated, storage emission is relatively high whereby total emission is also relatively high.

The present invention includes the appreciation that, during winter conditions, total emission may be minimized by taking into account the saturation expansion of the air/fuel vapor delivered to the storage tank. To this end, the present invention provides a gasoline vapor recovery system wherein, during winter conditions, the volume of the air/fuel vapor delivered to the storage tank ($V_{delivered}$) is less than the volume of liquid gasoline ($V_{liquid}$) but that will expand upon saturation in the storage tank to be approximately equal to the volume of the liquid gasoline ($V_{liquid}$).

Preferably, the volume of vapor delivered to the storage tank ($V_{delivered}$) is based on the fuel vapor saturation pressure at the temperature of the storage tank ($p_{sat}(T_{storage})$). More preferably, the volume of vapor delivered to the storage tank ($V_{delivered}$) is based on the equation:

$$V_{delivered}=V_{liquid}/(1+\Delta p/p_{ambient})$$

wherein $\Delta p=p_{sat}(\text{storage})-p_{vapor}(\text{delivered})$;

wherein $p_{sat}$ (storage)=saturation vapor pressure for the fuel at the temperature of the storage tank ; and wherein $p_{vapor}$(delivered)=vapor pressure at the rate-controlling device.

The saturation vapor pressure ($p_{sat}$(storage)) is preferably determined by measuring the temperature of the storage tank ($T_{storage}$) and then using this value to determine the saturation vapor pressure. Specifically, a stored table of saturation pressures at different temperatures for the particular fuel being pumped allows a look-up of the saturation pressure ($p_{sat}$) at the measured temperature of the storage tank ($T_{storage}$). The vapor pressure at the rate-controlling device is preferably determined by the concentration ($c_{delivered}$) of the vapor as delivered to the storage tank (such as by measuring its thermal conductivity) and then using this value to determine the saturation pressure.

Once within the storage tank, the volume of delivered vapor ($V_{delivered}$) saturates to expand to a volume approximately equal to the volume of liquid gasoline removed ($V_{liquid}$). In this manner, the storage tank remains at equilibrium pressure and vent emission is eliminated. It may be noted that, however, since $\Delta p$ is greater than zero, the volume of vapor removed from the car's fuel tank ($V_{car}$) is less than the volume of liquid gasoline dispensed therein ($V_{liquid}$). This volume differential ($V_{liquid}-V_{car}$) will be released at the nozzle thereby accounting for a nozzle emission of this amount times a concentration factor ($p_{sat}(T_{car})/p_{ambient}$).

In context of the above specific fuel and temperature example, removing a volume of vapor from the car's fuel tank ($V_{car}$) equal to 74.6% (100/1.34) of the dispensed liquid gasoline ($V_{liquid}$) would lead to an exact post-saturation volume match at the storage tank whereby there would be no vent emissions. Since the volume of vapor removed from the car's fuel tank ($V_{car}$) is less than the liquid gasoline dispensed therein ($V_{liquid}$), nozzle emission does occur of about 12.7% pure pentane (in percentage to the volume of dispensed liquid gasoline ($V_{liquid}$)) and thus there is a 12.7% total emission. Thus, while this method does not eliminate nozzle emission, it does substantially reduce total emission when compared to a method aimed at totally eliminating nozzle emission.

Accordingly, the present invention also includes the appreciation that total emission may be minimized in winter conditions if nozzle emissions are minimized instead of eliminated.

In summer conditions, the temperature of the car is greater than the temperature of the storage tank ($T_{car}>T_{storage}$, $t<1$) and the withdrawn vapor is cooled by the counter-flow and its volume contracts. ($V_{car}<V_{storage}$). If the volume of vapor withdrawn from the car's fuel tank ($V_{car}$) is set equal to the volume of the liquid gas dispensed therein ($V_{liquid}$), nozzle emission will be eliminated. However, the volume of vapor delivered to the storage tank will be less than the volume of liquid fuel dispensed therefrom ($V_{liquid}>V_{storage}$) thereby creating a vacuum within the storage tank. This vacuum is equalized by air being brought in through the storage tank's vent. The newly introduced air saturates with the vapor thereby expanding the vapor volume in the storage tank by a factor of $(1-t)\ (1+p_{sat}(T_{storage})/p_{ambient})$. The excess volume ($V_{liquid}\ (1-t))\ p_{sat}(T_{storage})/p_{ambient}$) is then released through the vent to equalize the pressure of the storage tank, a fraction $p_{sat}(T_{storage})/p_{ambient}$ of which is pure fuel vapor.

By way of specific example, suppose again that the fuel vapor is conservatively assumed to be pentane ($C_5H_{12}$), and that the temperature of the car ($T_{car}$) is 300° K and the temperature of the storage tank ($T_{storage}$) is 290° K. Withdrawing a volume of vapor at the nozzle ($V_{car}$) equal to the volume of liquid gasoline dispensed into the car's fuel tank ($V_{liquid}$), would result in a 52.3% expansion of the volume of air drawn in through the storage tank's vent and a 27.4% vent emission of pure pentane volume.

The present invention provides a gasoline vapor recovery system wherein, during summer conditions, the volume of vapor delivered to the storage tank ($V_{delivered}$) is saturated and equal to the volume of liquid gasoline withdrawn from the storage tank ($V_{liquid}$). This results in the volume of vapor withdrawn at the nozzle ($V_{car}$) being greater than the volume of liquid gasoline dispensed into the car's fuel tank ($V_{liquid}$) whereby nozzle emission is eliminated. The present invention includes the appreciation that, during summer conditions, any saturation of excess air withdrawn with the vapor will occur in the fuel hose, prior to the vapor being introduced into the storage tank. Accordingly, the volume of vapor introduced to the storage tank ($V_{storage}$) is equal to the volume of liquid gasoline ($V_{liquid}$) dispensed from the storage tank whereby vent emission is also eliminated.

Accordingly, the present invention provides a gasoline vapor recovery system wherein total emission is minimized by taking into account potential saturation expansion of a volume of air/fuel vapor after it is delivered to the storage tank. During winter conditions, nozzle emission may not be totally eliminated but total emission is minimized. During summer conditions, both nozzle emission and vent emission may be eliminated.

These and other features of the invention are fully described and particularly pointed out in the claims. The following description and drawings set forth in detail a certain illustrative embodiment of the invention, these embodiments being indicative of but one of the various ways in which the principles of the invention may be employed.

DRAWING

A schematic illustration of a fuel dispensing apparatus (e.g., a gasoline pump at a service station) including a gasoline vapor recovery system according to the present invention.

DETAILED DESCRIPTION

Referring now to the drawing, an apparatus 10 for dispensing a fuel such as liquid gasoline into a car's fuel tank 12 is schematically shown. The apparatus 10 includes a gasoline vapor recovery system 14 incorporating a controller 16 according to the present invention. The system 14 prevents the release of excessive gasoline vapors into the atmosphere and minimizes total emission regardless of weather and/or climate conditions.

The gasoline dispensing apparatus 10 includes a storage tank 20 in which liquid gasoline is stored and in which recovered vapor is also stored. The storage tank 20 includes a vent 22 for releasing vapor from the storage tank 20 if it becomes over-pressurized (e.g., greater than 3±0.5" $H_2O$ above ambient pressure) and for introducing air into the storage tank 20 if it becomes under-pressurized (e.g., greater than 8±2" $H_2O$ below ambient pressure). A pressure relief valve 24 is provided to control the release of vapor and the introduction of air through the vent 22.

The gasoline dispensing apparatus 10 also includes a fuel hose 30 extending from the fuel tank to a nozzle 32. The fuel hose 30 includes a central passageway 34 through which liquid gasoline flows towards the car's fuel tank 22 and an outer annular passageway 36 through which the recovered vapor flows in an opposite direction towards the storage tank 20. Thus, the liquid gasoline and the air/fuel vapor are in a heat-exchanging relationship within the fuel hose 30.

A pump 40 is provided to transport the liquid gasoline through the central passageway 34 to the nozzle 32 which may be appropriately controlled to dispense the fuel into the car's fuel tank 12. A flow meter 42 is provided to measure the volume of the liquid gasoline ($V_{liquid}$) from the storage tank 20 to the car's fuel tank 12. This measurement corresponds both to the volume of liquid gasoline dispensed into the fuel tank 12 and removed from the storage tank 20.

A constant speed suction pump 50*a* is provided to suction the vapor through the outer passageway 36 to the storage tank 20. In the illustrated embodiment, a proportional or modulating flow valve 50*b* works in conjunction with the suction pump 50*a* to control the volumetric flow rate of the recovered vapor and thus may be collectively viewed as a rate-controlling device 50. It may noted that this pump/valve rate-controlling device 50 could be replaced with a variable speed suction pump and the speed of the pump changed to vary the flow rate in the desired manner. A check valve 52 is provided to insure that residual vapor within the annular passageway of the fuel hose 32 does not escape to the atmosphere when the suction pump 50*a* is inactive (i.e., when gasoline is not being pumped).

The controller 16 receives input signals from the flow meter 42 (via control line 42*i*) to determine the volume of liquid gasoline ($V_{liquid}$) being discharged from the storage tank 20. Based on this determination, the controller 16 sends signals (via control output line 50*o*) to the flow-rate controlling device 50 so that the volume of vapor being delivered to the storage tank 20 ($V_{delivered}$) will balance the volume of liquid gasoline discharged ($V_{liquid}$) after any saturation occurs within the storage tank 20.

To this end, the controller 16 also receives input signals (via control lines 60*i*, 62*i*, and 64*i*) from sensors 60*a*, 60*b*, 62 and 64. The sensor 60*a* measures the volume of vapor being transferred by the device 50 ($V_{delivered}$) and the sensor 60*b* is used to determine the concentration of the vapor being delivered ($c_{delivered}$). For example, the sensor 60*b* could measure the thermal conductivity of the air/fuel vapor. The measurements provided by the sensors 60*a* and 60*b* are used to determine the vapor pressure at the device 50 whereby they may be collectively be referred to as a pressure-determining device 60. The sensor 62 senses the temperature at the storage tank ($T_{storage}$). The controller 16 further receives input signals from temperature sensor 66 and pressure sensor 68 (via control input lines 66*i* and 68*i*) which sense ambient properties ($T_{ambient}$, $p_{ambient}$). Thus, the flow-rate controlling device 50 is set at certain value by the controller 16 so that the desired volume of vapor is delivered to the storage tank 20.

During operation of the gasoline vapor recovery system 14, the controller 16 receives input signals from the liquid flow meter 42 as to the volume of liquid gasoline being pumped or, in other words, discharged from the storage tank 20 ($V_{liquid}$). If fuel is being pumped (i.e., $V_{liquid} \neq 0$), the controller 16 determines, based on inputs from sensor 62 ($T_{storage}$) and sensor 66 ($T_{ambient}$), whether the system 14 is operating under winter conditions (i.e., $T_{car} < T_{storage}$) or summer conditions (i.e., $T_{car} \geqq T_{storage}$).

If the system 14 is operating under winter conditions, the controller 16 uses the input from the storage tank temperature sensor ($T_{storage}$) to determine the saturation pressure of the gasoline vapor within the tank ($p_{sat}$(storage)). Preferably, the controller 16 has a stored table of saturation pressures corresponding to different temperatures for the particular gasoline being pumped to thereby determine the saturation pressure. The stored table or function may be changed or fluctuated to correspond to the season, region and/or gasoline supplier.

The controller 16 uses the input measurement from the vapor concentration sensor 60*b* ($c_{delivered}$) to determine vapor pressure at the rate-controlling device $p_{vapor}$ (delivered). This value $p_{vapor}$(delivered) is then used to calculate the pressure differential ($\Delta p$) between the vapor pressure of the vapor being delivered to the storage tank ($p_{vapor}$(delivered) and the saturation pressure corresponding to the temperature of the storage tank ($p_{sat}$(storage)). The controller 16 may also use the input signal from the vapor flow meter 60*a* ($\Delta G$) and the fuel vapor concentration sensor ($c_{delivered}$), along with the inputs from the storage tank temperature sensor 62 ($T_{storage}$) and the ambient pressure sensor ($p_{ambient}$) to determine the actual volume flow through the device ($V_{meter}$).

The input from the liquid flow meter 42 ($V_{liquid}$), the input from the ambient pressure sensor 64 ($p_{ambient}$) and the calculated pressure differential ($\Delta p$) are then used determine the desired volume of vapor to be delivered to the storage tank ($V_{delivered}$) Specifically:

$$V_{storage} = V_{liquid} / (1 + \Delta p / p_{ambient})$$

If the system 14 is operating under summer conditions, the controller 16 sets the desired volume of vapor to be delivered to the storage tank 20 equal to the volume of liquid gasoline removed from the storage tank ($V_{delivered} = V_{liquid}$), which results in excess air being sucked into through the nozzle.

Once the desired volume of air/fuel vapor to be delivered to the storage tank ($V_{delivered}$) is determined, the controller 16 sends output signals to the valve 50*b* corresponding to this desired volume. This series of determinations and calculations (starting with determining whether $V_{liquid} \neq 0$ and ending with the setting of the valve 50*b*) is then repeated until gasoline is no longer being pumped (i.e., $V_{liquid} = 0$).

One may now appreciate that the present invention provides a gasoline vapor recovery system wherein total emission is minimized by taking into account potential saturation expansion of a volume of air/fuel vapor after it is delivered to the storage tank, especially during winter conditions. Also, by measuring the air/fuel vapor flow and volume at essentially storage tank conditions, there is no need to follow the rapid vapor concentration dynamics of the air/fuel vapor from the car's fuel tank to the storage tank. Specifically, these vapor dynamics and/or temperature changes will have settled to equilibrium by the time the air/fuel vapor reaches the sensors 50 and 60. Although the invention has been shown and described with respect to a certain preferred embodiment, it is obvious that equivalent and obvious alterations and modifications will occur to others skilled in the art upon the reading and understanding of this specification.

What is claimed is:

1. A controller for a fuel vapor recovery system, the controller comprising:

an input reflecting a volume of liquid fuel transported from a storage tank to a nozzle for dispensing into a fuel tank of a car; and an output controlling a vapor recovery device that transports air/fuel vapor through the fuel line from the nozzle to the storage tank and that delivers a volume of the air/fuel vapor ($V_{delivered}$) to the storage tank; this output being set so that when the temperature of the storage tank is greater than the temperature of the car's fuel tank, the volume of air/fuel vapor delivered to the storage tank ($V_{delivered}$) is less than the volume of liquid gasoline ($V_{liquid}$) but expands upon saturation within the storage tank to be approximately equal to the volume of liquid gasoline ($V_{liquid}$);

wherein the controller determines the volume of vapor to be delivered to the storage tank ($V_{delivered}$) based on the fuel vapor saturation pressure at the temperature of the storage tank ($p_{sat}(T_{storage})$).

2. A fuel vapor recovery system for a fuel delivering apparatus having a fuel line through which a volume of liquid fuel ($V_{liquid}$) is transported from a storage tank to a nozzle for dispensing into a fuel tank of a car; said system comprising:

a vapor recovery device that transports air/fuel vapor through the fuel line from the nozzle to the storage tank and that delivers a volume of the air/fuel vapor ($V_{delivered}$) to the storage tank; and a controller that controls the vapor recovery device so that, when the temperature of the storage tank is greater than the temperature of the car's fuel tank, the volume of air/fuel vapor delivered to the storage tank ($V_{delivered}$) is less than the volume of liquid gasoline ($V_{liquid}$) but expands upon saturation within the storage tank to be approximately equal to the volume of liquid gasoline ($V_{liquid}$);

wherein the controller determines the volume of vapor to be delivered to the storage tank ($V_{delivered}$) based on the fuel vapor saturation pressure at the temperature of the storage tank ($p_{sat}(T_{storage})$).

3. A fuel delivering apparatus comprising:

a storage tank;

a fuel hose extending from the storage tank to a nozzle;

a pump that transports a volume of liquid fuel ($V_{liquid}$) through the fuel hose from the storage tank to the nozzle for dispensing into a fuel tank of a car;

a vapor recovery device that transports air/fuel vapor through the fuel hose from the nozzle to the storage tank and that delivers a volume of the air/fuel vapor ($V_{delivered}$) to the storage tank; and a controller that controls the vapor recovery device so that, when the temperature of the storage tank is greater than the temperature of the car's fuel tank, the volume of air/fuel vapor delivered to storage tank ($V_{delivered}$) is less than the volume of liquid gasoline ($V_{liquid}$) but expands upon saturation within the storage tank to be approximately equal to the volume of liquid gasoline ($V_{liquid}$);

wherein the controller determines the volume of vapor to be delivered to the storage tank ($V_{delivered}$) based on the fuel vapor saturation pressure at the temperature of the storage tank ($p_{sat}(T_{storage})$).

4. A fuel dispensing apparatus as set forth in claim 3, wherein the storage tank is situated underground.

5. A fuel dispensing apparatus as set forth in claim 4, wherein the fuel hose includes a central passageway through which the liquid gasoline is transported and an outer annular passageway through which the air/fuel vapor is transported.

6. A fuel dispensing apparatus as set forth in claim 5, wherein the recovery rate controlling device comprises a suction pump.

7. A fuel dispensing apparatus as set forth in claim 6, wherein the recovery rate controlling device comprises a constant suction pump and a valve positioned to control the flow rate of the pump and wherein the controller sends output signals to the valve to control its position.

8. A fuel dispensing apparatus as set forth in claim 7, wherein the controller receives input from a sensor that senses the temperature of the storage tank ($T_{storage}$).

9. A fuel dispensing apparatus as set forth in claim 8, wherein the controller determines the volume of vapor to be delivered to the storage tank ($V_{delivered}$) by the following equation:

$$V_{liquid}\ (1+\Delta p/p_{ambient})$$

wherein $\Delta p = p_{sat}(\text{storage}) - p_{vapor}(\text{delivered})$;

wherein $p_{sat}(\text{storage})$=saturation vapor pressure for the fuel at the temperature of the storage tank; and wherein $p_{vapor}(\text{delivered})$=fuel vapor pressure as the air/fuel vapor is delivered to the storage tank.

10. A fuel dispensing apparatus as set forth in claim 9, wherein the controller controls the vapor recovery device so that, when the temperature of the storage tank is less than or equal to the temperature of the car's fuel tank, the volume of air/fuel vapor delivered to the storage tank ($V_{delivered}$) is approximately equal to the volume of the liquid fuel ($V_{liquid}$).

11. A gasoline vapor recovery system for a gasoline delivering apparatus having a fuel line through which a volume of liquid fuel ($V_{liquid}$) is transported from a storage tank to a nozzle for dispensing into a fuel tank of a car; said system comprising:

a vapor recovery device that transports air/fuel vapor parallel and preferably concentric to the fuel line from the nozzle to the storage tank and that delivers a volume of the air/fuel vapor ($V_{delivered}$) to the storage tank; and a controller that controls the vapor recovery device to deliver the volume of vapor to the storage tank ($V_{delivered}$);

wherein the controller determines whether the system is operating in winter conditions or summer conditions by determining whether the temperature of the car is less than the temperature of the storage tank;

wherein, if the system is operating under winter conditions, the controller determines the volume to be delivered to the storage ($V_{delivered}$) by an equation:

$$V_{delivered} = V_{liquid}\ (1+\Delta p/p_{ambient})$$

wherein $\Delta p = p_{sat}(\text{storage}) - p_{vapor}(\text{device})$, wherein $p_{sat}(\text{storage})$=saturation vapor pressure for the fuel at the temperature in the storage tank, and wherein $p_{vapor}(\text{device})$=vapor pressure as delivered to the storage tank; and wherein, if the system is operating under summer conditions, the controller determines the volume to be delivered to the storage tank by an equation:

$$V_{delivered} = V_{liquid}.$$

12. A gasoline vapor recovery system as set forth in claim 11, wherein the controller receives input from a sensor that senses the temperature of the storage tank ($T_{storage}$) and wherein the controller uses this measured temperature to determine the saturation vapor pressure ($P_{sat}$(storage)).

13. A gasoline vapor recovery system as set forth in claim 12, wherein the controller uses cross-referenced data of saturation pressures and temperatures for the particular fuel being dispensed and whereby the controller is able to correlate the measured storage tank temperature with the fuel saturation pressure.

14. A gasoline vapor recovery system as set forth in claim 13, wherein the controller receives input from a sensor that measures thermal conductivity of the air/fuel vapor as it is being delivered to the storage tank and wherein this measurement is used to determine the fuel vapor pressure.

15. A method of delivering liquid fuel from a storage tank to a fuel tank of a car while minimizing total emission, said method comprising the steps of:

transporting a volume of liquid fuel ($V_{liquid}$) through a fuel line from the storage tank to the car's fuel tank;

recovering air/fuel vapor that is displaced in the car's fuel tank and delivering a volume of the air/fuel vapor ($V_{delivered}$) to the storage tank; and controlling the recovering step so that, when the temperature of the storage tank is greater than the temperature of the car's fuel tank, the volume of air/fuel vapor delivered to storage tank ($V_{delivered}$) is less than the volume of liquid gasoline ($V_{liquid}$) but expands upon saturation within the storage tank to be approximately equal to the volume of liquid gasoline ($V_{liquid}$);

wherein the controlling step includes determining the volume of vapor to be delivered to the storage tank ($V_{delivered}$) based on the fuel vapor saturation pressure at the temperature of the storage tank ($p_{sat}(T_{storage})$).

16. A method as set forth in claim 15, wherein the recovering and delivering step is performed by a suction pump.

17. A method as set forth in claim 16, wherein the recovering and delivering step is performed by a suction pump and wherein the controlling step comprises controlling the position of a valve located to control the flow rate of air/fuel vapor mixture driven by the suction pump.

18. A method as set forth in claim 17, wherein the determining step includes determining the volume of vapor to be delivered to the storage tank ($V_{delivered}$) by the following equation:

$$V_{liquid}(1+\Delta p/p_{ambient})$$

wherein $\Delta p = p_{sat}(\text{storage}) - p_{vapor}(\text{delivered})$;

wherein $p_{sat}$(storage)=saturation vapor pressure for the fuel at the temperature of the storage tank; and wherein $p_{vapor}$(delivered)=fuel vapor pressure as the air/fuel vapor is delivered to the storage tank.

* * * * *